US006926132B1

(12) United States Patent
Sonntag et al.

(10) Patent No.: US 6,926,132 B1
(45) Date of Patent: Aug. 9, 2005

(54) HOLD DOWN ASSEMBLY, WITH TUBULAR CONTAINER TRANSPORT APPARATUS AND METHODOLOGY INCORPORATING THE SAME

(75) Inventors: Donald W. Sonntag, Carl Junction, MO (US); Jack L. Johnson, Baxter Springs, KS (US); Randy Jones, Carthage, MO (US)

(73) Assignee: Reagent Chemical & Research, Inc., Ringoes, NJ (US)

( * ) Notice: Subject to any disclaimer, the term of this patent is extended or adjusted under 35 U.S.C. 154(b) by 118 days.

(21) Appl. No.: 10/697,966

(22) Filed: Oct. 29, 2003

Related U.S. Application Data

(60) Provisional application No. 60/423,306, filed on Nov. 1, 2002.

(51) Int. Cl.[7] ..... B65G 47/04

(52) U.S. Cl. ..... 198/477.1; 198/474.1; 198/867.12; 198/377.05

(58) Field of Search ..... 198/375, 377.01, 198/377.05, 377.06, 377.09, 867.12, 377.1, 198/378, 483.1, 477.1, 482.1, 469.1, 474.1, 198/472.1

(56) References Cited

U.S. PATENT DOCUMENTS

| | | | | |
|---|---|---|---|---|
| 3,747,737 | A * | 7/1973 | Brooke | 198/377.06 |
| 4,441,878 | A * | 4/1984 | Harry | 198/483.1 |
| 4,640,406 | A * | 2/1987 | Willison | 198/470.1 |
| 4,801,001 | A * | 1/1989 | Gibbemeyer | 198/468.2 |
| 5,121,827 | A * | 6/1992 | Ribordy | 198/377.06 |
| 5,165,521 | A * | 11/1992 | Schweitzer et al. | 198/477.1 |
| 5,316,127 | A * | 5/1994 | Evrard | 198/470.1 |
| 6,311,830 | B1 * | 11/2001 | Grimm | 198/477.1 |

* cited by examiner

*Primary Examiner*—James R. Bidwell
(74) *Attorney, Agent, or Firm*—Timothy J. Martin; Michael R. Henson; Rebecca A. Gegick

(57) ABSTRACT

A hold down assembly for use in a tubular container transport apparatus comprises upper and lower pieces movably mounted relative to one another. Preferably the lower piece is removably seated on a mounting plate of the transport apparatus and the upper piece is adapted to magnetically interact with a tube holder carrying a filled tube product, such that the tube holder may be retained in registered alignment relative to an ejector rod during ejection of the filled tube product. A tubular container transport apparatus and a methodology for ejecting a filled tube product with a reduced risk of dislodgement are also provided.

30 Claims, 6 Drawing Sheets

HOLD DOWN ASSEMBLY, WITH TUBULAR CONTAINER TRANSPORT APPARATUS AND METHODOLOGY INCORPORATING THE SAME

This application claims benefit of Provisional Application No. 60/423,306, filed Nov. 1, 2002.

FIELD OF THE INVENTION

The present invention broadly relates to apparatus for use during the manufacturing process of producing filled-tube products. More particularly, the present invention is directed to hold down assemblies for use during the ejection stage of the manufacturing process. The invention specifically concerns hold down assemblies which reduce or prevent the risk of dislodgement of tube holders during the ejection stage of the manufacturing process, as well as methodologies incorporating the same.

BACKGROUND OF THE INVENTION

The packaging of products for storage and consumption is a significant global industry. Various known packages include cartons, boxes, cans, tubes, and pouches, to name a few. Packaged products encompass virtually any type of product that is available for consumption from large appliances to small incidental items.

One of the major types of packaging is the tubular container. A tubular container is generally circular in configuration, although other tubular container cross sections are known. Typically, these tubular containers are sealed at each end by an end closure. In some instances, the end closure is provided by a creased or folded seal so that the container takes on what is known as a tooth-paste tube configuration. Other tubular containers have end closures that are either pressed fit or roll sealed on the end of the tube.

When tubular containers are filled with the desired commodity, a bulk supply of tubes is usually provided with each of these tubes having one end closure already in place. The tube is placed vertically in a machine with the open end of the container oriented vertically. The commodity to be packaged is then dispensed into the tubular container and the remaining open end is sealed so that the product is packaged for ultimate use.

In one type of manufacturing process used, a transport apparatus is used which contains a plurality of tube holders which receivably retain the tubes at different stages while they are being filled and sealed. Typically, this process also includes an unload stage whereby the filled and sealed tube is ejected from its tube holder and deposited into a collection bin or the like. During the unload process, an unload assembly typically has an ejector rod which travels upwardly through the tube holder to punch-out the tube.

Unfortunately, it is not uncommon during the unload stage for the unload assembly and the associated tube holder to improperly align in registration with one another such that the ejector rod does not properly contact the tube as it plunges upwardly in an effort to knock out the tube from its holder. This can cause improper ejection of the filled tube, dislodgement of its tube holder, or other problems which disrupt the manufacturing process. Accordingly, there remains a need to provide a new and useful apparatus and methodology for ensuring proper alignment and registration of tube holders with unload assemblies during the unload stage of the manufacturing process. There is a further need to overcome the drawbacks associated with the prior art in such a manner which does not disrupt the manufacturing process. The present invention is particularly directed to satisfying these needs.

SUMMARY OF THE INVENTION

It is an object of the present invention to provide a new and useful improvement to a tubular container transport apparatus, and particularly the unload station thereof.

Another object of the present invention to provide a new and useful hold down assembly for use during a manufacturing process involved in the production of filled tube products.

Yet another object of the present invention to provide such a hold down assembly for use during the unload/ejection stage of the manufacturing process whereby filled tubes are ejected for collection.

A further object of the present invention is to provide such a hold down assembly which is selectively adjustable to accommodate varying production parameters.

Still a further object of the present invention is to provide such a hold down assembly which reduces the risk of dislodgement of tube holders during the production process.

It is still a further object of the present invention to provide such a hold down assembly which is relatively easily constructed and which may be retrofitted for use with existing unload stage constructions.

It is still yet another object of the present invention to provide a method for preventing dislodgement, or reducing the risk of dislodgement, of tube holders during the unload/ejection stage of the manufacturing process for creating filled tube products.

In accordance with these objectives, the present invention in one sense relates to an improvement, in the form of a hold down assembly, to a tubular container transport apparatus that is used during the production of filled tube products. Transport apparatus includes spaced apart upper and lower platforms mounted for relative movement, such as being journaled for relative rotation about an axle. A plurality of tube holders are supported by the upper platform, and a drive motor is employed for moving the platforms relative to one another into indexed positions. The base platform incorporates an unload station which includes a mounting plate and an associated ejector rod. The ejector rod is operative, when a tube holder carrying a filled tube product is indexed into an unload position above the base platform, to travel upwardly through the tube holder to eject the filled tube product out of the holder so that it may be collected.

The hold down assembly of the present invention is disposed proximately to the ejector rod and is adapted to be magnetically interfaced between the base platform and the tube holder as the tube holder is indexed into the unload position. Broadly, the hold down assembly comprises a lower piece seated on the mounting plate and an upper piece moveably mounted to the lower piece and adapted to magnetically interact with a bottom of the tube holder, thereby retaining the tube holder in registered alignment relative to the ejector rod during ejection of the filled tube product.

The hold down assembly is suitable for use with known tube holders which are provided with a central opening at their base and a metallic annular ring surrounding the central opening. With such an environment, the upper piece of hold down assembly preferably includes a plurality of magnetic elements, such as neodymium discs, for interacting with the metallic annular ring along magnetic lines of force. To this end, the upper piece may include an annular end cap which supports the neodymium discs.

In the exemplary embodiment, the upper and lower pieces are telescopically mounted to one another and generally cylindrical in configuration, with the upper piece being telescopically received within the lower piece. The pieces are moveably mounted to one another whereby height of the hold down assembly can be selectively adjusted. A locking structure, which may be in the form of a threaded bolt and a locking handle, is employed to retain the pieces in a selected locked position.

It is preferred that the lower piece be removably and magnetically seated on the mounting plate through which the ejector rod travels so that, in the event of a collision between the hold down assembly and a traveling tube holder, the hold down assembly can break away from its magnetic coupling to the mounting plate. To this end also, the hold down assembly is constructed to prevent damage to the ejector rod in the event of a collision. This is accomplished by a slotted channel formed in each of the upper and lower pieces. More particularly, the lower piece preferably includes a slotted channel extending between its opposed ends which is sized and adapted to register with an elevated alignment notch on the mounting plate so that this slotted channel is oriented in an upstream facing direction when magnetically coupled to the mounting plate. The upper piece preferably also includes a slotted channel which extends less than its height so that it resembles an archway. The upper piece slotted channel is rotatably alignable with the slotted channel associated with the lower piece when the hold down assembly is telescopically mounted. In this manner, an inadvertent collision between the traveling tube holder and the hold down assembly will enable the hold down assembly to break away from the mounting plate, whereby the ejector rod can passes through the aligned slotted channels and avoid contact with the hold down assembly.

In addition to an improvement to a tubular container transport apparatus, the present invention also particularly relates to a hold down assembly for use with such a transport apparatus. Here, the hold down assembly broadly includes a lower piece adapted to be removably seated on the mounting plate, and an upper piece movably mountable to the lower piece and adapted to magnetically interact with the metallic base of the tube holder as the tube holder is indexed into the unload position, thereby to retain the tube holder in registered alignment relative to the ejector rod during ejection of the filled tube product. The hold down assembly preferably has the features discussed hereinabove. Finally, the present invention also relates to an improvement in the form of a methodology for ejecting a filled tube product from a tube holder with a reduced risk of dislodgement of the tube holder from the upper platform. According to this methodology, the upper platform is indexed so that the tube holder carrying the filled tube product is advanced toward the unload station. The tube holder is magnetically urged into the unload position wherein the tube holder is placed in registered central alignment above the ejector rod. The tube holder is magnetically retained in the unload position. The ejector rod is then actuated whereby it travels upwardly from a retracted position toward an extended position and through the tube holder to eject the filled tube product therefrom. The ejector rod is then allowed to return to the retracted position. This methodology can also provide for thereafter indexing the upper platform so that the tube holder is urged out of registered, central alignment above the ejector rod.

These and other objects of the present invention will become more readily appreciated and understood from a consideration of the following detailed description of the exemplary embodiments of the present invention when taken together with the accompanying drawings, in which:

BRIEF DESCRIPTION OF THE DRAWINGS

FIG. 12(*b*) is a perspective view of the hold down assembly of the present invention shown in an elevated position;

FIG. 13(*b*) is a side view in elevation of the unload stage as the filled tube-product is ejected from its tube holder.

DETAILED DESCRIPTION OF THE EXEMPLARY EMBODIMENTS

The present invention relates in one sense, to a tube hold down assembly that may be used to improve the efficiency of the manufacturing process involved in the production of filled tube products. Accordingly, the present invention not only contemplates the mechanical structure of such a hold down assembly, but also the method that is inherent in the structure, all of which is described below. Moreover, it should be understood that, while the present invention is described with respect to cylindrical tubular containers having flexible sidewalls, the ordinarily skilled artisan would be able to employ both the process and the apparatus with containers of different shapes and configurations with an appreciation of the teachings herein.

Figure 1:
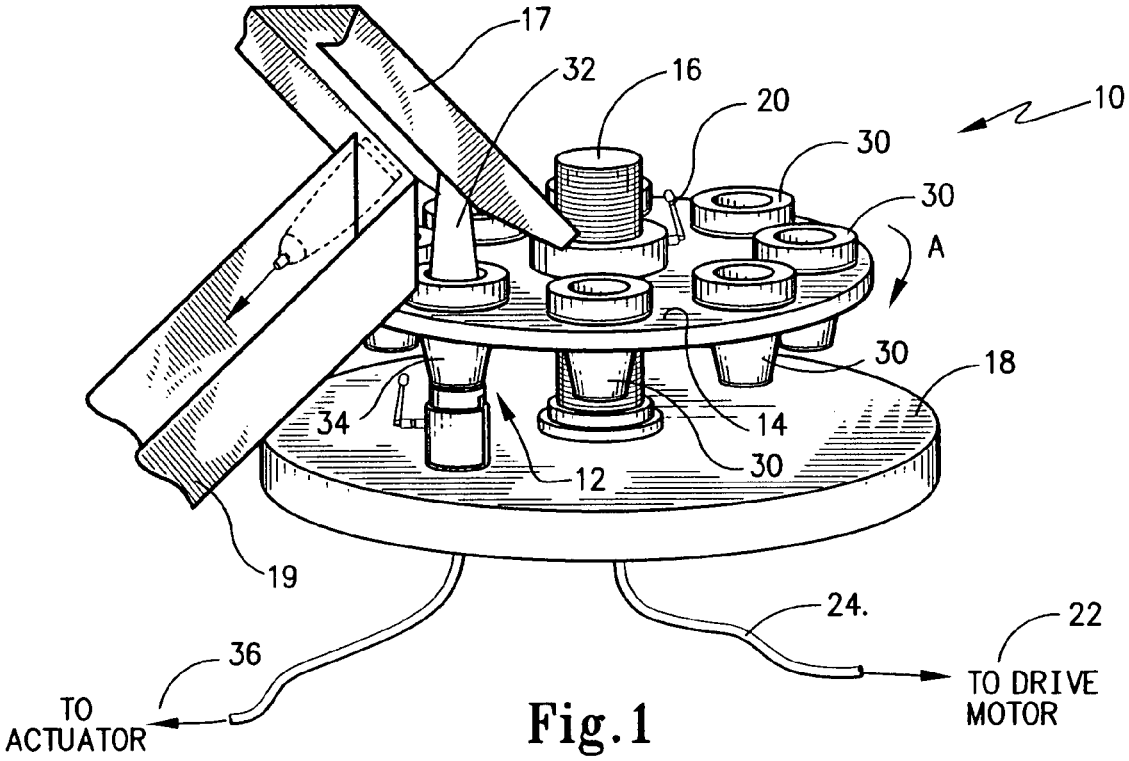
FIG. 1 is a perspective view of a transport apparatus incorporating, at the tube unload stage thereof, the hold down assembly of the present invention.

To better appreciate the environment of the present invention, reference is made initially to FIG. 1 which depicts a tubular container transport apparatus 10 for use during the manufacturing process involved in producing filled tube products. Transport apparatus 10 has a variety of stages, but only the filled tube hold down and ejection/unloading stage 12 is illustrated in FIG. 1. However, while various other components of the transport apparatus are not shown which correspond to precursor stages in the production process, the ordinarily skilled artisan would appreciate that transport apparatus 10 can be used with other subassemblies to accomplish loading of empty tubular containers into associated tubular holders, filling of the tubular containers with fill material, sealing of the tubular containers, and ultimately to transport associated tubular containers to the hold down and unloading station 12 depicted in FIG. 1.

Transport apparatus 10 includes an upper platform in the form of an indexing dial/turntable 14 which may be rotatably journaled in the direction of arrow "A" in FIG. 1 about an axle 16. Spaced below indexing dial 14 is a lower base platform 18. Upper indexing dial 14 can be positioned a selective distance above base plate 18 by virtue of its threaded attachment to axle 16. Once the desired spacing has been selected, a locking handle 20 can be manipulated to fix the displacement between indexing dial 14 and base plate 18. Rotation of indexing dial 14 is accomplished by an appropriate drive motor 22 which is operatively connected to transport apparatus 10 in any appropriate manner known in the art. It should be appreciated that FIG. 1 is only representative of one possible tube transport apparatus configuration, and the ordinarily skilled artisan would readily appreciate that a variety of different constructions could be employed. Furthermore, the height adjustment between the turntable dial 14 and its base 18 could be accomplished in a variety of known manners, as could the actuation of the turntable 14 in order to impart rotary movement thereto, such that the present invention should in no way be limited to the manner particularly depicted in the figures.

In any event, as may also be seen in FIG. 1 indexing dial 14 is adapted to receive a plurality of tube holders 30 for receiving the tubes, whether they be empty, filled or filled and sealed. Accordingly, once a filled and sealed tube, such as representative tube 32 in FIG. 1, is indexed within its associated tube holder 34 to unload station 12, it is ejected therefrom by an unload apparatus. More particularly, station 12 includes a tube hold down and unload assembly (discussed below) which operates upon activation by an actuator 36 to eject tube 32 upwardly whereby it is deflected by a deflector shield 17 and sent down a chute 19 where it and other subsequently ejected tubes can be collected in an appropriate collection bin. Preferably, both the deflector 17 and the chute 19 are fixedly positioned proximate to station 12 by appropriate mounting equipment, as would be readily appreciated by those skilled in the art. In addition, both the deflector 17 and the chute 19 can be selectively adjustable in height so that their precise relative positions proximate to station 12 can be varied as desired. This ability would also be well within the purview of the ordinarily skilled artisan.

Figure 2:
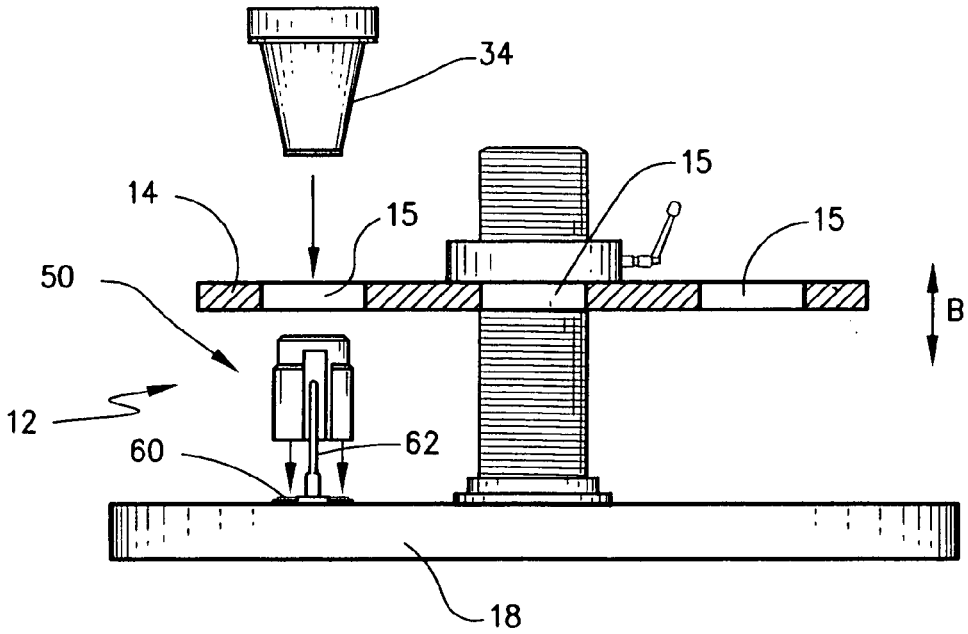
FIG. 2 is an exploded side view in elevation, and in partial cross-section, showing the unload stage depicted in FIG. 1.
Figure 3:
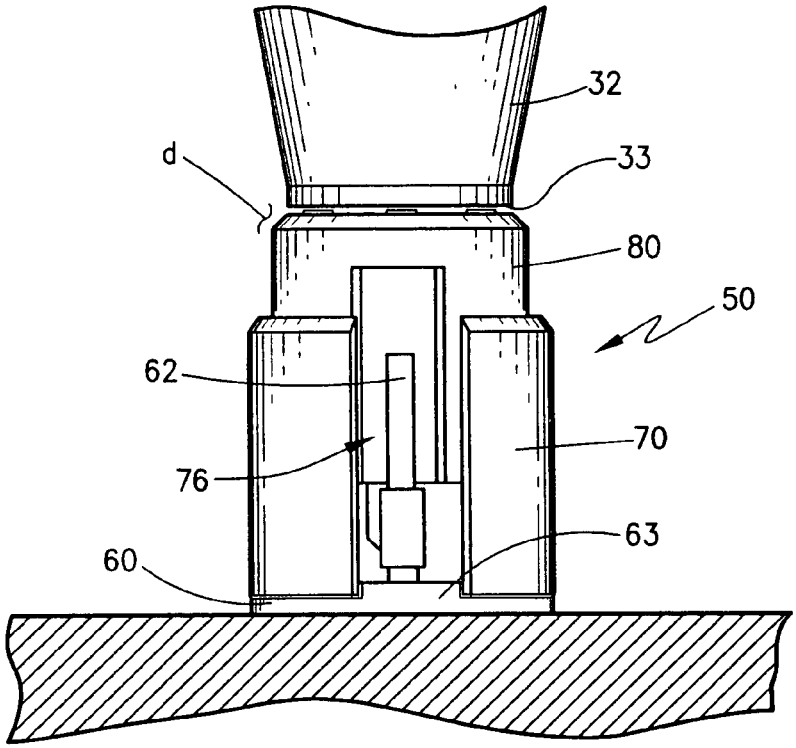
FIG. 3 is an enlarged partial side view, as viewed generally from the right side of FIG. 1, illustrating the unload stage, and particularly showing the magnetic coupling between the hold down assembly and its associated tube holder.

As shown in FIG. 2, indexing dial 14 includes a plurality of openings 15 which are sized and adapted to receive an associated tube holder, although only one such holder 34 is shown in FIG. 2 as it reaches station 12. Tube holder 34 is preferably tapered in construction so that it can be conveniently received within its associated opening 15. As also shown in FIG. 2, located at station 12 is a tube hold down assembly 50 which, as discussed in greater detail below, is magnetically seated on a platform 60 that includes an ejector rod 62 which may be hydraulically actuated by an appropriate actuator to move upwardly and punch out a filled tube. Of course, the ejection process could be accomplished by any of a variety of mechanical, automated or manual means. Together, hold down assembly 50 and the ejector apparatus, which includes mounting plate 60, ejector rod 62 and the actuator, comprise a hold down and ejection assembly. Depending on the size of tube holder 34 employed, which may for example be dictated by the type of tube being filled, the height of the transport assembly's dial 14 is adjusted whereby the received tube holder 34 is spaced a slight distance "d" of about 1/16 inch above the top of hold down assembly 50, as shown in FIG. 3, so that these pieces do not interfere with one another during rotation of turntable 14. Alternatively, or in conjunction with this adjustment capability, hold down assembly 50 can also have its height adjusted to achieve this minimal distance "d" between the bottom 33 of tube holder 32 and the top of hold down assembly 50. This adjustment capability will be described in greater detail below with reference to FIGS. 12(*a*) and 12(*b*). To this end, assembly 50 as shown in various figures is a telescoping structure which includes an upper member 80 of generally cylindrical configuration telescopically received within a lower member 70 which is also generally cylindrical in configuration.

Figure 4:
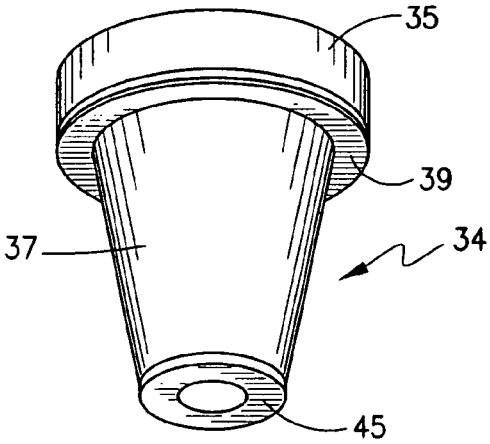
FIG. 4 is a perspective view of a tube holder for use with the present invention.
Figure 5:
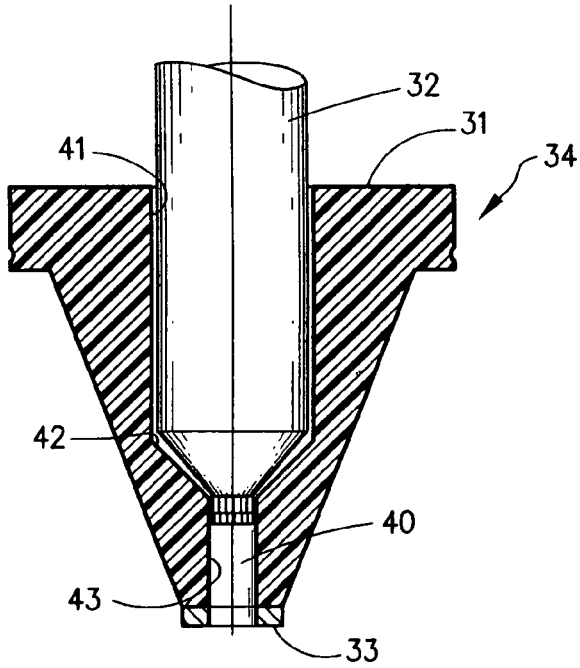
FIG. 5 is a side view in cross-section of the tube holder shown in FIG. 4, with a representative filled product tube inserted therein.
Figure 6:
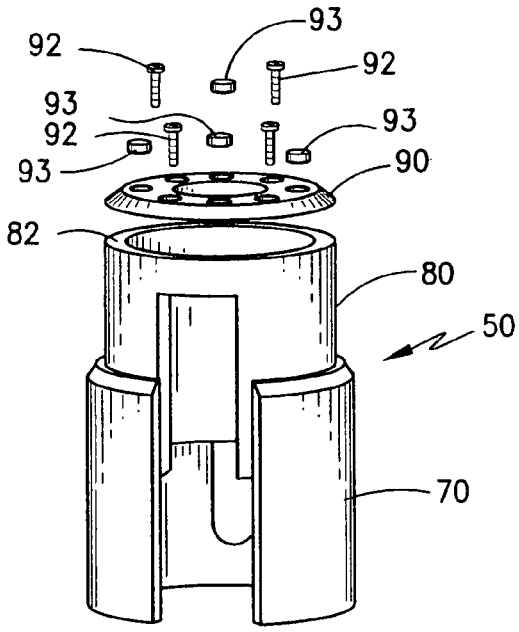
FIG. 6 is an exploded perspective view of the hold down assembly of the present invention.
Figure 7:
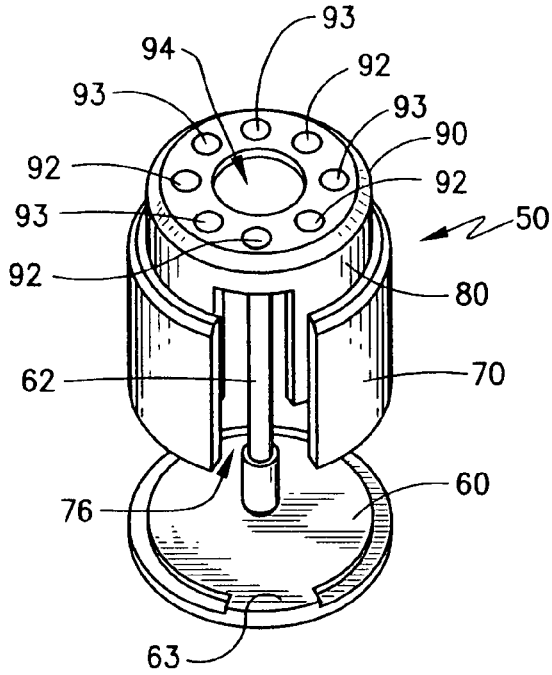
FIG. 7 is a exploded perspective view of the hold down assembly of the present invention situated above its mounting base.

A preferred construction for tube holder 34 will now be described with reference to FIGS. 4 and 5 which show such construction particularly suitable for use with a tube 32 in the form of a conventional toothpaste tube. Tube holder 34 may be constructed of a suitable plastic material to have a generally frustoconcial configuration. Accordingly, tube holder 34 has an upper enlarged annular ring portion 35 and a tapering lower portion 37. Annular ring portion 35 has an enlarged circumference relative to lower portion 37 so that a lower brim 39 thereof rests upon the upper surface of dial 14 when tube holder 34 is removably received within the opening 15. A central longitudinal bore 40 is formed through tube holder 34 and is configured to accommodate received tube 32 in a close-fitted, nested engagement. As such, bore 40 preferably tapers in construction from the upper surface 31 of tube holder 34 towards the lower surface 33 thereof. As shown in FIG. 5, bore 40 is formed by an upper cylindrical cavity 41 having a dimension for accommodating the widest sidewall portion of tube 32, followed by an inwardly tapering conical cavity portion 43 for accommodating the nose portion of tube 32, and finally a smaller cylindrical cavity 43 for accommodating the closure cap of tube 32. Tube holder 34 also includes a metallic annular ring 45 made of ferrous metal or the like disposed on the lowermost portion of tapering conical portion 37 to define lower end 33. Annular ring 45 may be permanently attached to portion 37 via an appropriate bonding adhesive, screw fasteners or any other appropriate means such that it is permanently mounted thereto. It should be appreciated that the tube holder 34 shown in FIGS. 4 and 5 can take on a variety of configurations depending on the particular tube which it receives. Moreover, where a toothpaste-type tube is employed as shown in the figures, it should also be appreciated that the configuration for the tube holder 34 can likewise take on a variety of different constructions such that FIGS. 4 and 5 are only illustrative of one such embodiment.

The assemblage for hold down assembly 50, as well as the construction for its various components, may now be best appreciated with reference to FIGS. 6–11. With initial reference to FIGS. 6 and 7, hold down assembly 50 includes the lower and upper telescopic pieces 70 and 80 discussed above, which may be constructed of aluminum or the like. Upper telescopic piece 70 incorporates an end cap 90. End cap 90 is preferably an annular ring of plastic construction or other appropriate material which may be mounted to the upper surface 82 of the inner, upper telescopic member 80 via a plurality of fastening screws 92 or the like. Again, attachment could be accomplished by any appropriate techniques, such as adhesive bonding or the like. Alternatively still, the upper end of member 80 could be formed to include upwardly projecting cylindrical posts sized to be received in correspondingly configured cavity in end cap 90 to accomplish a close-fitted engagement therebetween. Annular end cap 90 also includes a plurality of cavities formed therein for nestably receiving magnets 93. Each magnet 93 is preferably a rare earth neodymium magnet having a disc shape.

Figure 8:
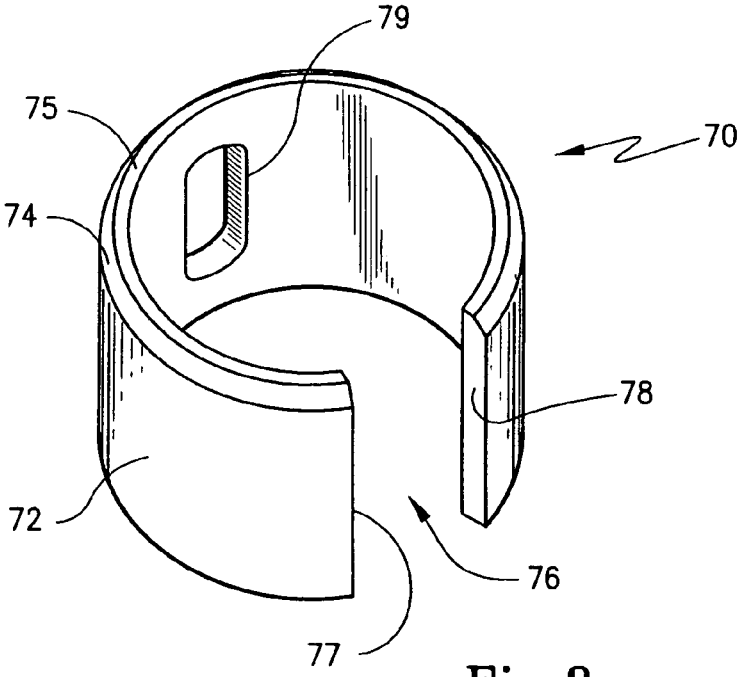
FIG. 8 is a perspective view of the lower, outer telescopic member which forms a component of the hold down assembly of the present invention.
Figure 9:
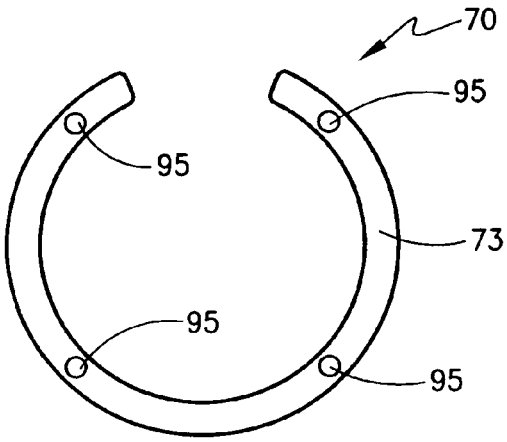
FIG. 9 is a bottom plan view of the lower, outer telescopic member shown in FIG. 8.

As shown in FIGS. 8 and 9, lower telescopic member 70 has an outer surrounding sidewall is arcuate in shape and extends around a majority a circle so that member 70 is generally cylindrical in configuration. Sidewall 72 has an inwardly tapering upper ledge 74 which terminates in a rim 75. Sidewall 72, however, is not completely circuitous. Rather, a slotted opening 76 extends completely therethrough such that there is a gap between end vertical walls 77 and 78. In addition, a generally rectangular opening 79 is also formed through sidewall 72 opposite slotted gap 76. As shown in FIG. 9, the base 73 of lower telescopic member 70 is also provided with a plurality of magnetic elements 95, preferably neodymium discs, which are either permanently adhered thereto or appropriately received in corresponding cavities formed in the sidewalls base 73.

Figure 10:
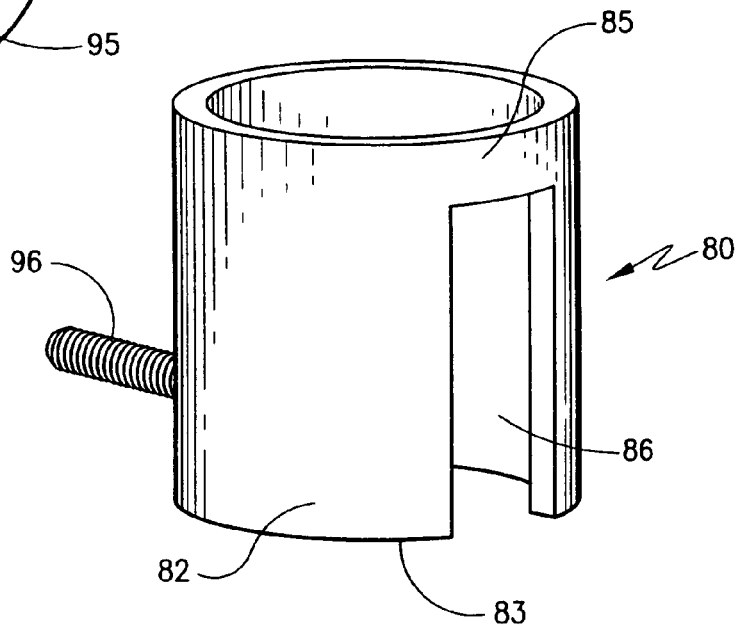
FIG. 10 is a perspective view of the inner, upper telescopic member for the hold down assembly of the present invention, and showing a threaded screw attached thereto.

Inner, upper telescopic member 80 is shown in FIG. 10 to also be generally cylindrical in construction. This piece also includes a slotted opening 86 formed through a portion of its sidewall 82. However, slotted opening 86 does not extend the entire height of telescopic member 80. Rather, opening 86 extends from bottom wall 83 upwardly to terminate shy of upper wall 85, thereby to form a bridge 85. Projecting from sidewall 82 oppositely of opening 86 is an adjustment screw 96 which may be appropriately fastened to sidewall 82 such as through a threaded bore (not shown) formed therein, a weldment, or the like.

Figure 11:
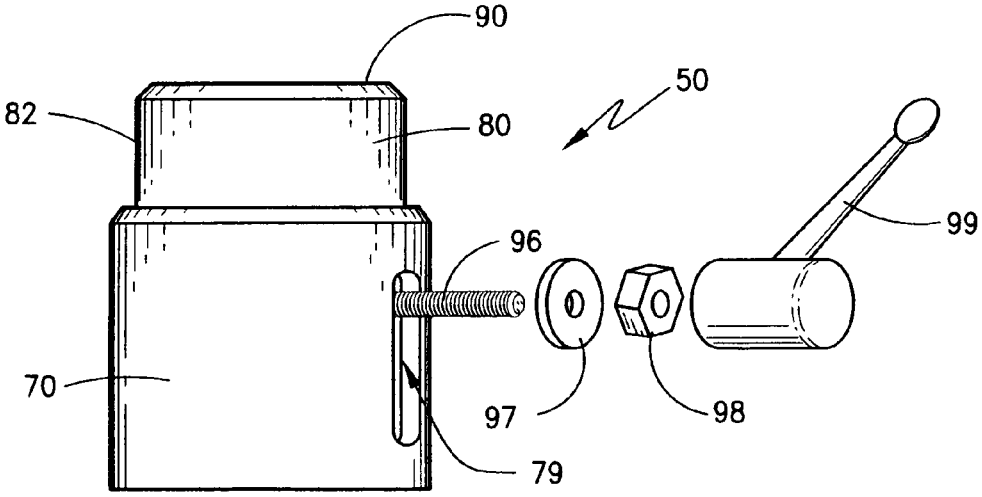
FIG. 11 is an exploded perspective view showing a locking structure for use with the hold down assembly of the present invention.

One manner of assembling the various pieces which form hold down assembly 50 is shown in FIG. 11. Upper telescopic member 80 has an outer diameter which closely approximates the inner diameter of lower telescopic member 70 so that it, with its attached protective cap 90, can be slideably inserted therein as shown in FIG. 11. Member 80 is then rotated so that its slotted opening 86 (FIG. 10) aligns with slotted opening 76 (FIG. 8) formed through lower telescopic member 70. Screw 96 may then be inserted through opposed opening 79 associated with member 70 and threadedly fastened to member 80. A washer 97 is received over screw 96 followed by a hex nut 98. A locking handle 99 is received over hex nut 98 whereby rotation of locking handle 99 serves to lockingly engage upper and lower telescopic members 80 and 70 relative to one another selectively between two extreme adjustment positions.

Figure 12A:
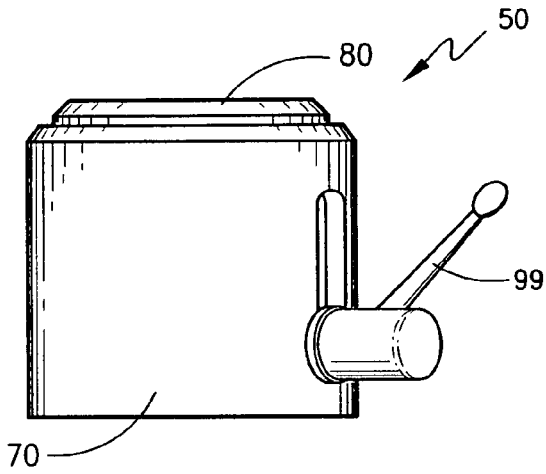
FIG. 12(*a*) is a perspective view showing the hold down assembly of the present invention locked in an unelevated position.
Figure 12B:
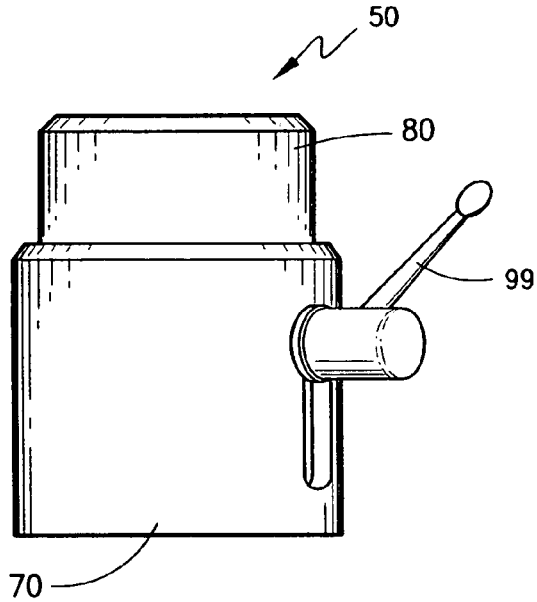

FIG. 12(*a*), for example, shows assemblage 50 having its telescopic member 70 and 80 situated in their lowermost/unelevated position while FIG. 12(*b*) shows an elevated arrangement for telescopic members 70 and 80 with them being at their maximum telescopic height. Of course, the ordinarily skilled artisan should readily appreciate that a variety of other types of locking constructions could be utilized in order to selectively position members 70 and 80 relative to one another, other than the arrangement particularly illustrated in FIGS. 11, 12(*a*) and 12(*b*). For example only, a caming construction could be utilized.

With reference again to FIGS. 3 and 7, hold down assembly 50 is rotated such that the slotted opening 76 of lower telescopic member 70 aligns with a raised alignment notch 63 formed on mounting plate 60. As such, openings 76 and 86 face in an upstream direction during use, as shown in FIG. 1. Mounting plate 60 is preferably formed of a ferrous metal so that the magnetic elements associated with lower telescopic member 70 magnetically coupled thereto. It may also be seen with reference to these same figures that the slotted openings 76 and 86 formed in lower and upper telescopic members 70 and 80 allow for the entire hold down assembly 50 to break away from base plate 60 and its associated ejector rod 62 during operation. This may be useful, for example, if tubular holder 34 projects downwardly a sufficient distance such that rotation of the transport apparatus dial 14 would result in a collision between tube holder 34 and hold down assemblage 50. This might arise for a variety of reasons. For example, if the tube holder 34 is of the wrong size, or if inappropriate adjustments are made for either the height of the turning dial 14 relative to its base 18 or inappropriate telescopic height adjustment of the hold down assemblage 50 itself. In any event, it there happens to be a collision between the tube holder 34 and the hold down assembly 50, the slotted openings permit the hold down assembly 50 to break away from its base 18 without damaging other components, namely ejector rod 62.

Figure 13A:
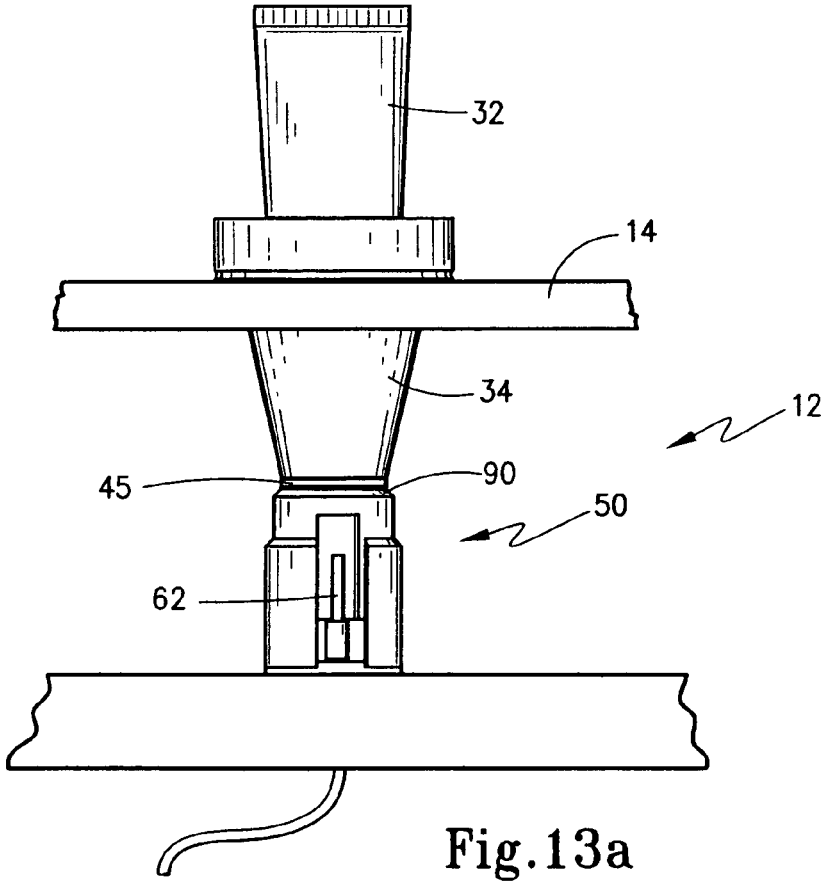
FIG. 13(*a*) is a side view in elevation of the unload stage immediately prior to ejection of the filled-tube product.
Figure 13B:
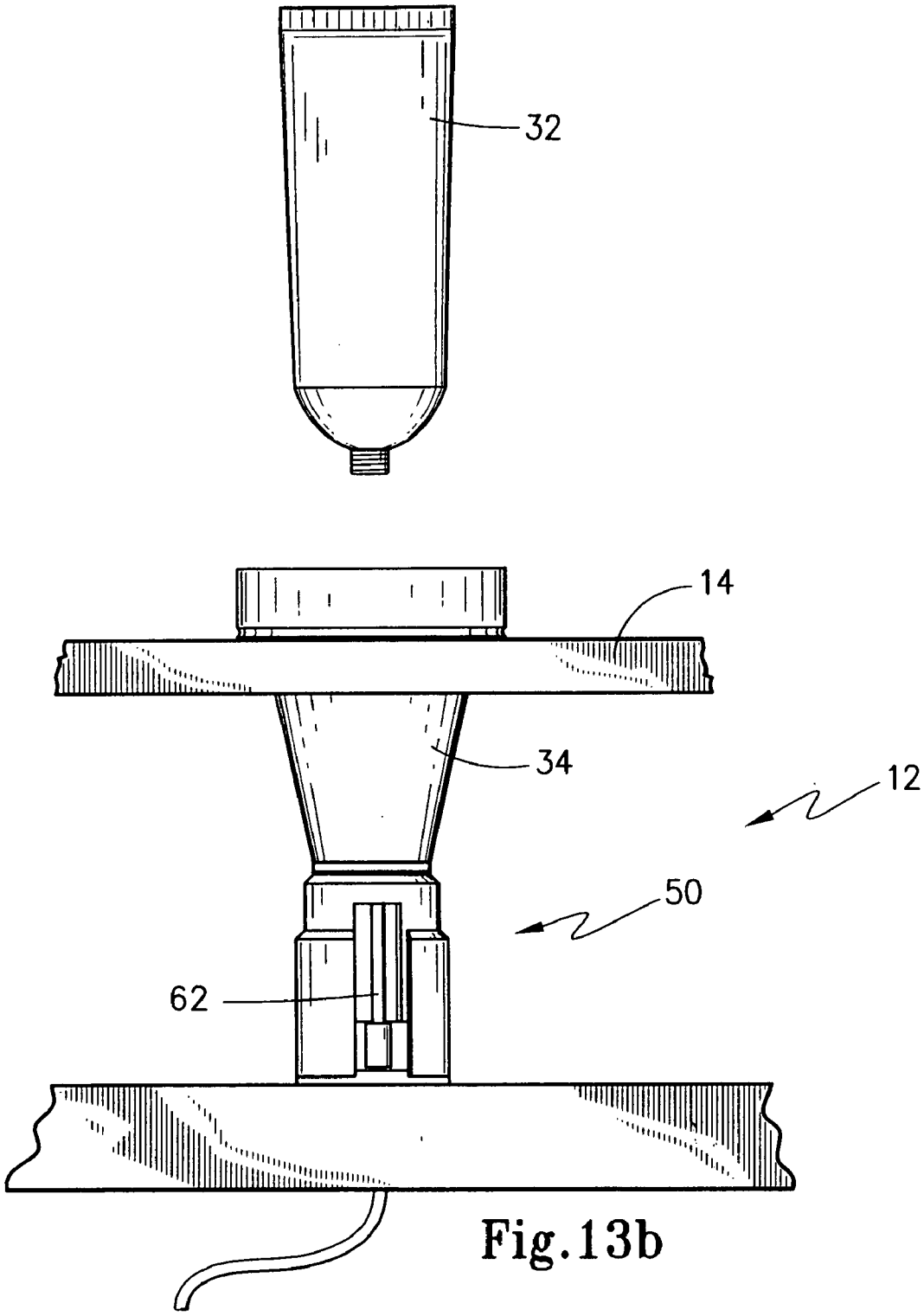

With the above description in mind, aspects of the operation of the hold down and ejection stage 12 can be appreciated with reference now to FIGS. 13(*a*) and 13(*b*). FIG. 13(*a*) shows the invention once the transport apparatus has initially indexed the tube holder 34 into registration vertically above hold down assembly 50. Once the transport apparatus dial 14 reaches this position, tube holder 34 is urged downwardly into registered alignment centrally above the hold down assembly 50, and particularly the ejector rod, by virtue of the magnetic attraction between its ferrous metal annular base 45 and the upper annular ring 90 associated with hold down assembly 50 which contains the neodymium magnets. Alternatively, of course the construction of the pieces could be reversed with the magnets being situated in the base of the tube holder 34. At this point, the filled tube 32 is ready to be ejected from tube holder 34 and ejector rod 62 is initially at its retracted position shown in FIG. 13(*a*). Appropriate controls can be implemented to then activate the actuator of FIG. 1 whereby this ejector rod 62 thrusts upwardly as shown in FIG. 13(*b*) to eject the filled tube 32 from its tube holder 34. By virtue of the magnetic coupling between tube holder 34 and hold down assembly 50, they are vertically aligned with one another, such that the upward movement of the ejector rod 62 properly contacts the filled tube, resulting in proper tube ejection and preventing unwanted disruption during the unload stage.

From the foregoing description, it should also be appreciated that the present invention also relates to an improvement in the form of a methodology for ejecting a filled tube product from a tube holder with a reduced risk of dislodgement of the tube holder from the upper platform. According to this methodology, the upper platform is indexed so that the tube holder carrying the filled tube product is advanced toward the unload station. The tube holder is magnetically urged into the unload position wherein the tube holder is placed in registered central alignment above the ejector rod. The tube holder is magnetically retained in the unload position. The ejector rod is then actuated whereby it travels upwardly from a retracted position toward an extended position and through the tube holder to eject the filled tube product therefrom. The ejector rod is then allowed to return to the retracted position. This methodology can also provide for thereafter indexing the upper platform so that the tube holder is urged out of registered, central alignment above the ejector rod.

It should be appreciated from the foregoing that variations of the constructions described may be made by the ordinarily skilled artisan in this field without departing from the inventive concepts herein. Moreover, it should also be appreciated that the methodology of the present invention can include any of the processing steps, not limited to those discussed hereinabove, that can be accomplished by the above-described structures.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

What is claimed is:

1. In a tubular container transport apparatus for use during the production of filled tube products, wherein said transport apparatus includes spaced apart upper and lower platforms moveably mounted relative to one another, a plurality of tube holders supported by said upper platform, a drive motor for moving the upper and lower platforms relative to one another into indexed positions, and an unload station disposed on said base platform, wherein said unload station includes a mounting plate and an associated ejector rod that is operative, when a tube holder carrying a filled tube product is indexed into an unload position above said base platform, to travel upwardly through a bottom of said tube holder to eject the filled tube product out of said tube holder for collection, the improvement comprising:

a hold down assembly disposed proximately to said ejector rod and adapted to be magnetically interfaced between said base platform and said tube holder as said tube holder is indexed into the unload position, said hold down assembly comprising a lower piece seated on said mounting plate and an upper piece movably mounted to said lower piece and adapted to magnetically interact with a bottom of said tube holder, thereby to retain said tube holder in registered alignment relative to said ejector rod during ejection of the filled tube product.

2. The improvement according to claim 1 wherein said lower piece is magnetically seated on said mounting plate.

3. The improvement according to claim 2 wherein said mounting plate is a metallic member and said lower piece includes a plurality of magnetic elements for magnetically coupling to said mounting plate.

4. The improvement according to claim 3 wherein each of said magnetic elements is a neodymium disc.

5. The improvement according to claim 1 wherein a lower portion of said tube holder includes a central opening through which said ejector rod travels during ejection of the filled tube product and a metallic annular ring surrounding said central opening, and wherein the upper piece of said hold down assembly includes a plurality of magnetic elements for interacting with said metallic annular ring along magnetic lines of force.

6. The improvement according to claim 5 wherein said upper piece includes an annular end cap which supports said magnetic elements.

7. The improvement according to claim 6 wherein each of said magnetic elements associated with said upper piece is a neodymium disc.

8. The improvement according to claim 1 wherein said upper and lower pieces are telescopically mounted to one another.

9. The improvement according to claim 8 wherein each of said upper and lower pieces is generally cylindrical in configuration, and wherein said upper piece is telescopically received within said lower piece.

10. The improvement according to claim 9 wherein said upper piece includes an annular end cap which supports a plurality of magnetic elements.

11. The improvement according to claim 10 wherein each magnetic element is a neodymium disc.

12. The improvement according to claim 1 wherein said upper and lower pieces are movably mounted relative to one another whereby height of said hold down assembly can be selectively adjusted.

13. The improvement according to claim 12 including a locking structure for retaining said upper and lower pieces in a selected locked position.

14. The improvement according to claim 1 wherein said hold down assembly is removably seated on said mounting plate and is constructed, in the event of a collision with said tube holder, to break away from said mounting plate without damaging said ejector rod.

15. The improvement according to claim 14 wherein each of said upper and lower pieces is generally cylindrical in configuration and includes rotatably aligned, slotted channels facing in an upstream direction so that, when a collision causes said hold down assembly to break away from said mounting plate, said ejector rod passes though the aligned slotted channels and avoids contact with said hold down assembly.

16. A hold down assembly for use in a tubular container transport apparatus during the production of filled tube products, wherein said transport apparatus includes spaced apart upper and lower platforms moveably mounted to one another, a plurality of bored tube holders each supported by said upper platform and having a metallic base, a drive motor for moving said upper and lower platforms relative to one another into indexed positions, and an unload station associated with said base platform which includes a mounting plate and an associated ejector rod, said ejector rod being operative when a tube holder carrying a filled tube product is indexed into an unload position above said base platform to travel upwardly through the tube holder to eject the filled tube product out of said tube holder, said hold down assembly comprising:

a. a lower piece adapted to be removably seated on said mounting plate; and b. an upper piece movably mountable to said lower piece and adapted to magnetically interact with the metallic base of said tube holder as said tube holder is indexed into the unload position, thereby to retain said tube holder in registered alignment relative to said ejector rod during ejection of the filled tube product.

17. A hold down assembly according to claim 16 wherein said upper and lower pieces are telescopically mounted to one another.

18. A hold down assembly according to claim 17 wherein each of said upper and lower pieces is generally cylindrical in configuration, with said upper piece being telescopically received within said lower piece.

19. A hold down assembly according to claim 18 wherein said upper piece includes an annular end cap provided with a plurality of first magnetic elements operative to interact with the metallic base of said tube holder along magnetic lines of force.

20. A hold down assembly according to claim 19 wherein said lower piece includes a plurality of second magnetic elements for magnetically coupling said lower piece to said mounting plate.

21. A hold down assembly according to claim 20 wherein said first magnetic elements are circumferentially distributed about a central longitudinal axis of said upper piece, and wherein said second magnetic elements are circumferentially distributed about a central longitudinal axis of said lower piece.

22. A hold down assembly according to claim 18 wherein said lower piece has an associated lower piece sidewall which extends around a majority of a circle to form a lower piece slotted channel extending between opposed end walls thereof, and wherein said upper piece has an associated upper piece sidewall having an upper piece slotted channel formed therethrough which is configured as an archway.

23. A hold down assembly according to claim 22 wherein said mounting plate includes an elevated alignment notch facing in an upstream direction on the base platform, and wherein said lower piece slotted channel is sized and adapted to accommodate said alignment notch thereby to rotatably orient said lower piece slotted channel in the upstream direction.

24. A hold down assembly according to claim 23 wherein said upper and lower pieces are adapted to be movably mounted to one another at a selected telescopic height with said upper and lower slotted channels in radial alignment with one another.

25. A hold down assembly according to claim 24 including a locking structure for retaining said upper and lower pieces at the selected telescopic height.

26. A hold down assembly according to claim 25 wherein said locking structure includes a threaded bolt extending radially outwardly from said upper piece sidewall through an aperture formed through said lower piece sidewall, and a locking handle threadedly engaging said bolt.

27. A hold down assembly according to claim 16 wherein said upper piece is telescopically mounted to said lower piece, and including a locking structure for selectively mounting said upper and lower pieces at a desired telescopic height.

28. A hold down assembly according to claim 27 wherein said upper piece includes a plurality of first magnetic elements for magnetically interacting with the metallic base of said tube holder along magnetic lines of force, and wherein said lower piece includes a plurality of second magnetic elements for magnetically coupling to said mounting plate.

29. In a tubular container transport apparatus for use during the production of filled tube products, wherein said transport apparatus includes spaced apart upper and lower platforms mounted for relative movement, a plurality of circumferentially distributed tube holders supported by said upper platform, a drive motor for moving said upper and lower platforms relative to one another into indexed positions, and an unload station associated with said base platform which includes a metallic mounting plate and an associated ejector rod that is operative, when a filled tube product is indexed into an unload position above said base platform, to travel upwardly from a retracted position to an extended position to eject the filled tube product out of its associated tube holder for collection, the improvement comprising a method of ejecting the filled tube product from said tube holder with a reduced risk of dislodgment of said tube holder from the upper platform, said method comprising:

a. indexing said upper platform so that the tube holder carrying said filled tube product is advanced toward the unload station;

b. magnetically urging said tube holder into the unload position wherein said tube holder is placed in registered, alignment centrally above said ejector rod;

c. magnetically retaining said tube holder in the unload position;

d. actuating said ejector rod whereby said ejector rod travels upwardly toward the extended position and through said tube holder to eject said filled tube product therefrom; and e. allowing said ejector rod to return to the retracted position.

30. A method according to claim 29 comprising thereafter indexing said upper platform so that said tube holder is urged out of registered, alignment centrally above said ejector rod.

* * * * *